US006901615B1

(12) United States Patent
Lombardo et al.

(10) Patent No.: US 6,901,615 B1
(45) Date of Patent: Jun. 7, 2005

(54) BEACH UMBRELLA TOWEL

(76) Inventors: Concetta Lombardo, 350 Northfield Ave., West Orange, NJ (US) 07052; Angela Casiero, 56 Manger Rd., Cedar Knolls, NJ (US) 07927

( * ) Notice: Subject to any disclaimer, the term of this patent is extended or adjusted under 35 U.S.C. 154(b) by 0 days.

(21) Appl. No.: 10/749,547

(22) Filed: Jan. 2, 2004

(51) Int. Cl.[7] ..... A47G 9/06
(52) U.S. Cl. ..... 5/417; 5/418; 5/419
(58) Field of Search ..... 5/417–419, 922; 135/16; 248/519

(56) References Cited

U.S. PATENT DOCUMENTS

| | | | | | |
|---|---|---|---|---|---|
| 2,420,344 | A | * | 5/1947 | Cook | 2/69 |
| 2,533,322 | A | | 12/1950 | Kober | 135/16 |
| 2,898,609 | A | * | 8/1959 | Storie | 5/419 |
| 2,907,057 | A | | 10/1959 | Specht | 5/417 |
| 3,237,904 | A | | 3/1966 | Abruzese | 248/508 |
| 3,689,947 | A | * | 9/1972 | Wolf | 5/419 |
| 4,599,754 | A | | 7/1986 | Mairs, III et al. | 5/418 |
| 4,980,935 | A | * | 1/1991 | Kazanowski et al. | 5/419 |
| 5,059,463 | A | | 10/1991 | Peters | 428/64.1 |
| 5,110,219 | A | * | 5/1992 | Lopes | 383/4 |
| 5,347,667 | A | | 9/1994 | Schwarz et al. | 5/418 |
| 5,427,346 | A | * | 6/1995 | Urgola | 248/519 |
| D360,793 | S | | 8/1995 | Nwani | D6/597 |
| 5,729,846 | A | * | 3/1998 | Sullivan | 5/419 |
| 5,819,343 | A | | 10/1998 | Zampirri, Jr. et al. | 5/417 |
| 5,899,571 | A | | 5/1999 | Chalk | 383/4 |
| 6,061,850 | A | * | 5/2000 | Roper, III | 5/418 |
| 6,182,309 | B1 | * | 2/2001 | Sullivan | 5/419 |
| 6,502,257 | B1 | | 1/2003 | Glenn | 5/418 |
| 2003/0019034 | A1 | | 1/2003 | Hyduk | 5/417 |

FOREIGN PATENT DOCUMENTS

| | | |
|---|---|---|
| FR | 2 400 843 | 3/1979 |
| FR | 2 589 702 A1 | 5/1987 |

* cited by examiner

*Primary Examiner*—Robert G. Santos
(74) *Attorney, Agent, or Firm*—Richard C. Litman

(57) ABSTRACT

The beach umbrella towel has an aperture for inserting a beach umbrella in various places, and the towels can have various shapes such as rectangular, square or circular. Pillows of various shapes are attached around the aperture in various configurations.

13 Claims, 10 Drawing Sheets

BEACH UMBRELLA TOWEL

BACKGROUND OF THE INVENTION

1. Field of the Invention

The present invention relates generally to towels and pillows. More specifically, the invention is a beach towel having various geometric shapes, and is used in conjunction with an umbrella by having an aperture for the umbrella handle in a selected location. There are pillows proximate the aperture.

2. Description of the Related Art

The related art of interest describes various beach towels, but none discloses the present invention. There is a need for a combination beach towel having an aperture for the post or handle of a beach umbrella and at least one attached pillow for lying comfortably on the beach. The related art will be discussed in the order of perceived relevance to the present invention.

U.S. Pat. No. 6,502,257 B1 issued on Jan. 7, 2003, to Rosemary Glenn describes a beach blanket for receiving an umbrella so that the umbrella is positioned over the blanket comprising a flexible square panel having a centered opening with a doubled circular device angled at an incline over the aperture and supported by a flexible plate with fastening means such as hook and loop fastening, snaps or zippers. The device is distinguishable for requiring a fixed support around the opening.

U.S. Pat. No. 5,347,667 issued on Sep. 20, 1994, to Sam Schwarz et al. describes a protective beach appliance comprising a satchel for carrying a beach umbrella having a handle in three parts, and a rectangular blanket having a centered opening with a protective ring. The device is distinguishable for requiring a protective ring for the opening.

U.S. Pat. No. 2,533,322 issued on Dec. 12, 1950, to Saul Kober describes a beach umbrella comprising a folding umbrella having a small circular table on its handle and inserted through a wood center piece of a circular ground cloth having a zipper from the center out to the peripheral edge. The device is distinguishable for requiring a wood center piece and a zipper in the circular ground cloth.

France Patent Application No. 2 589 702 A1 published May 15, 1987, to Marc Legayan describes a parasol head rest comprising a parasol attachable to a foam or inflatable mattress consisting of a foam or inflatable head rest on a metal or polyvinyl chloride tubular frame, and having a fixed or orientable fastening system. The device is distinguishable for requiring a foam or inflatable mattress and attachment to an edge of the headrest portion.

U.S. Des. Pat. No. 360,793 issued on Aug. 1, 1995, to Solomon Nwani describes an ornamental combined beach mat and sunshade comprising a rectangular rubber or plastic mat having a built-in pillow and two sunshades with an upright rod at one end. The combined ornamental beach mat and sunshades is distinguishable for requiring a built-in pillow and two sunshades.

U.S. Pat. No. 2003/0019034 A1 published on Jan. 30, 2003, for Michael A. Hyduk describes a kit of beach products comprising a rectangular towel having loops at each corner, ground anchor pins, a capped cup holder, and a flag. The kit is distinguishable for lacking an aperture in the towel for anchoring a beach umbrella.

U.S. Pat. No. 2,907,057 issued on Oct. 6, 1959, to Lisa M. Specht describes a rectangular beach sheet and six anchoring pins for the sheet's grommets. The device is distinguishable for requiring grommets and anchoring pins, and lacking an aperture for a beach umbrella.

U.S. Pat. No. 3,237,904 issued on Mar. 1, 1966, to Michael Abruzese describes a beach blanket anchor comprising four headed staffs to anchor a rectangular beach blanket at its corners. The beach blanket is distinguishable for lacking an aperture for a beach umbrella.

U.S. Pat. No. 4,599,754 issued on Jul. 15, 1986, to Robert W. Mairs, III et al. describes a combination wind screen and beach blanket apparatus comprising a rectangular beach blanket having a pair of apertures in each corner for inserting a pair of poles to support two upright screen assemblies on two adjacent sides. The apparatus is distinguishable for requiring poles and screens.

U.S. Pat. No. 5,059,463 issued on Oct. 22, 1991, to Michael V. Peters describes a folding mat and shelter apparatus comprising a circular mat held by an outer rim reinforced by a steel ribbon. Three tent stakes at the periphery of the mat hold the mat in place. Three frame members made of fiberglass or metal pivot from diametrically opposed points. The frame members support a two-piece cover made of a nylon-Dacron mesh material. A center hole having a closable flap can be used for an umbrella. The circular mat is made of a soft cellular foam such as neoprene rubber covered by a Lycra fabric. A rectangular storage pouch is integrated with the mat proximate an edge and can be used as a pillow. The apparatus is distinguishable for requiring a circular mat having three frame members and a tent cover.

U.S. Pat. No. 5,819,343 issued on Oct. 13, 1998, to Dominic C. Zampirri, Jr. et al. describes a multi-purpose combination blanket and tote bag comprising a circular towel converted to form a large tote bag with a spring-loaded clip and drawstrings. When open, the blanket is 82 inches in diameter. The blanket has a layer of absorbent cotton blend cloth backed by a layer of waterproof nylon. The blanket has a double drawstring channel two-thirds away from its center having waterproof lining. A large grommet located proximate an edge of the blanket would accommodate a beach umbrella. The spring-loaded clip is attached to the side of the blanket-bag or, alternatively, to its bottom center to engage the drawstrings to form a carrying strap. The device is distinguishable for requiring a combination blanket and tote bag configuration with a spring clip to engage the drawstrings to form a carrying strap.

U.S. Pat. No. 5,899,571 issued on May 4, 1999, to Damon T. Chalk describes a beach towel, tote bag and beach umbrella system comprising a circular terry cloth towel member seven feet in diameter having a peripheral drawstring, a circular terry cloth umbrella member of the same diameter connected by a 2 part upright umbrella support pole. The device is distinguishable for requiring a tote bag configuration for the towel and umbrella.

France Patent No. 2 400 873 published on Mar. 23, 1979, for Jacques Galko describes as best understood a base cloth having a small base (or foot end) connected by its wider head portion to a semicircular shaped and zippered pouch with an apertured horizontal stand for supporting a beach umbrella located between two hand grips. The pouch has a zipper opening adjacent the head portion for rolling in the base portion. The device is distinguishable for requiring a zippered holding bag and an external horizontal apertured stand for holding an umbrella.

None of the above inventions and patents, taken either singly or in combination, is seen to describe the instant invention as claimed. Thus, a beach umbrella towel solving the aforementioned problems is desired.

SUMMARY OF THE INVENTION

The beach umbrella towel is used in conjunction with a beach or picnic umbrella. The towel can have a variety of shapes such as rectangular, square or circular. There is at least one aperture in a selected place in the towel to locate an umbrella post or handle. One to four stuffed pillows having rectangular, arcuate or circular shapes are attached to the towel adjacent the aperture, by either hook and loop fastening or sewing.

Accordingly, it is a principal object of the invention to provide a beach umbrella towel.

It is another object of the invention to provide a beach umbrella towel having at least one aperture for locating the post or handle of a beach umbrella.

It is a further object of the invention to provide a beach umbrella towel having a variety of shapes such as rectangular, square or circular.

Still another object of the invention is to provide a beach umbrella towel having one to four pillows attached.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a first embodiment in FIGS. 1A through 1F of a rectangular beach umbrella towel 10 comprising a towel having an aperture 12 and up to four stuffed rectangular pillows 14 attached to the beach towel by hook and loop fastening or sewn at one end (hidden). The beach pillows in this invention all have one edge that is extended to allow the attachment of hook or loop fastening patches to appropriate loop or hook fastening patches on the towel 10.

Figure 1A:
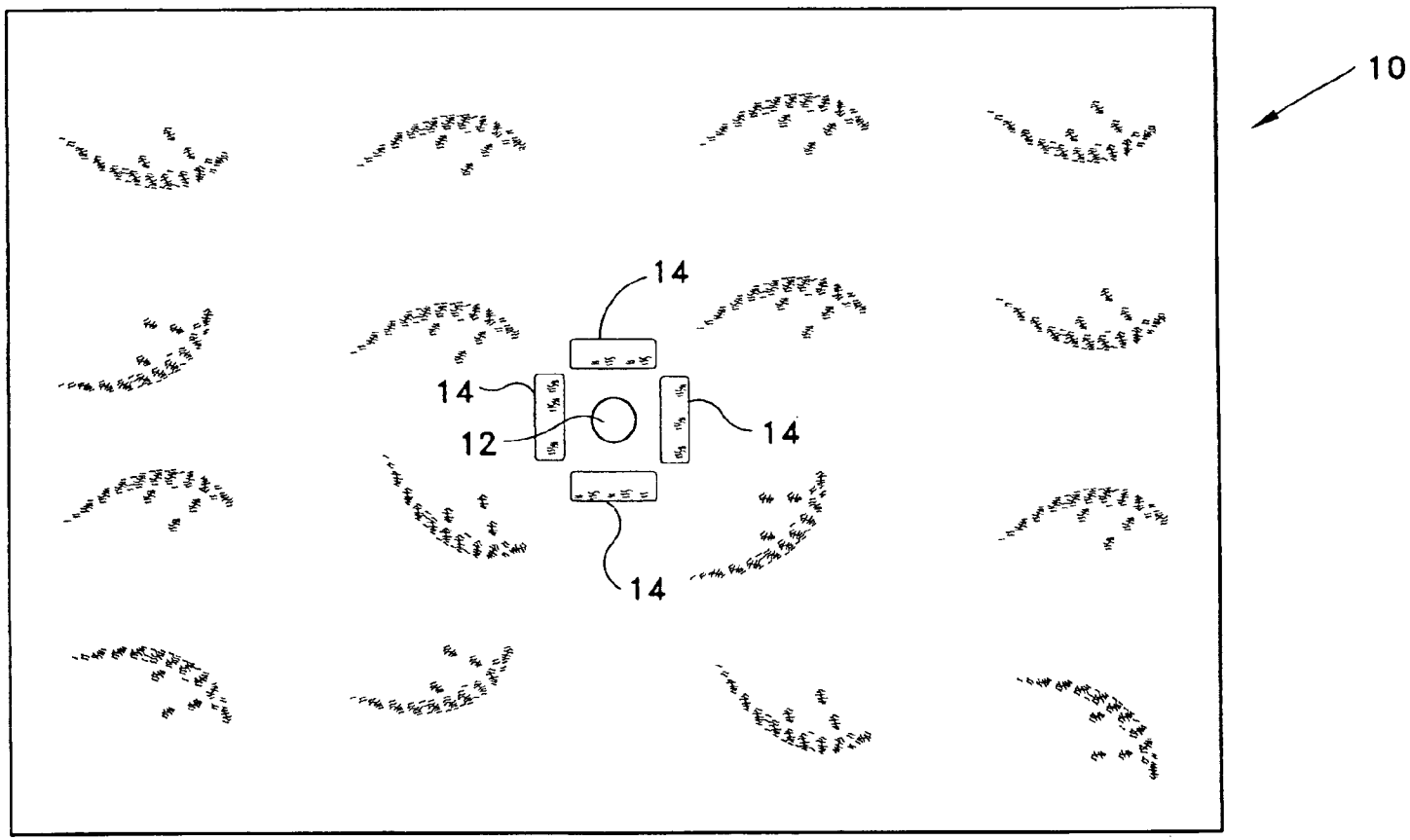
FIGS. 1A–1F are top plan views of six different rectangular beach umbrella towel arrangements, wherein each towel has an aperture for a beach umbrella and pillow(s), all according to the present invention.
Figure 1B:
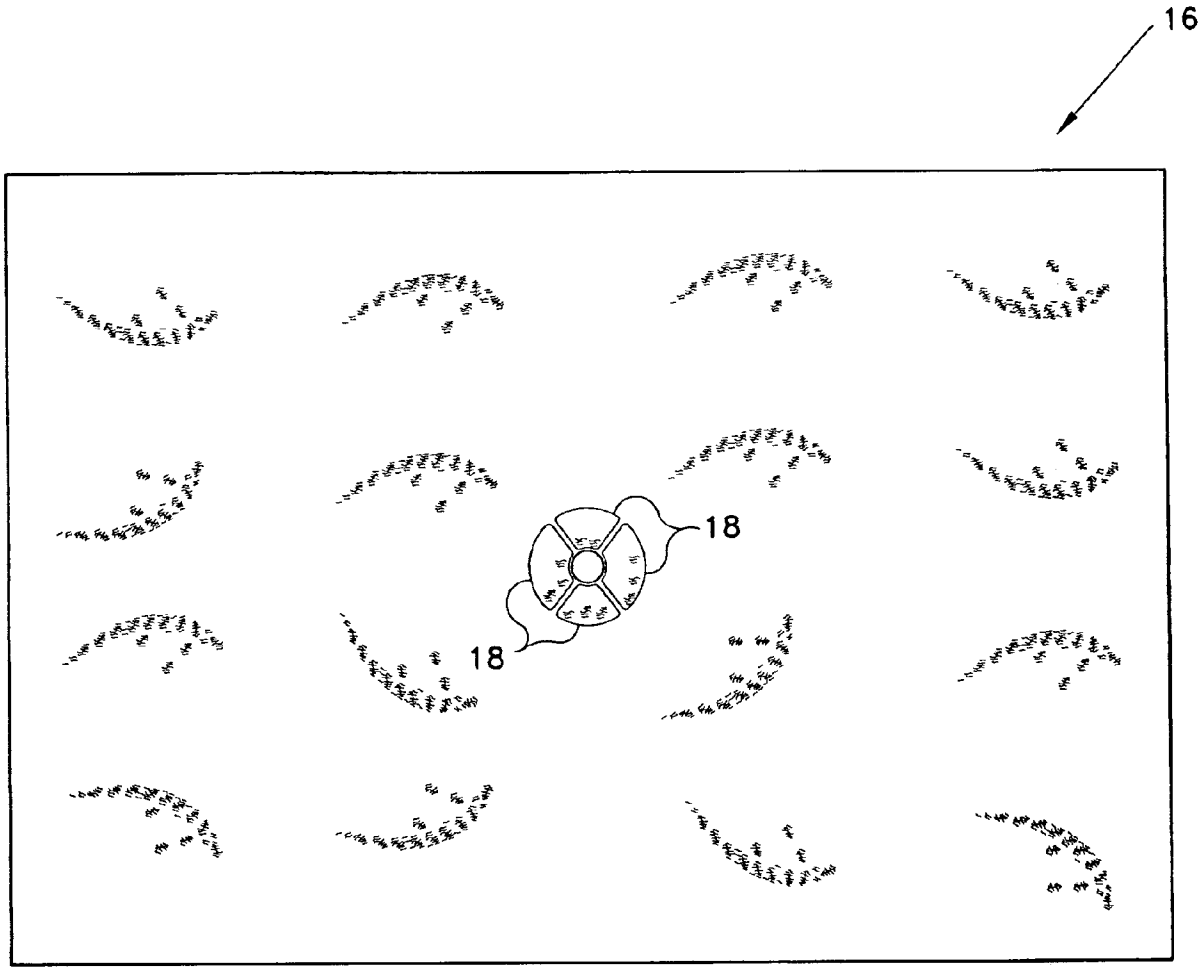

FIG. 1B has the aperture 12 located in the center of the rectangular towel 16 with four arcuate pillows 18.

Figure 1C:
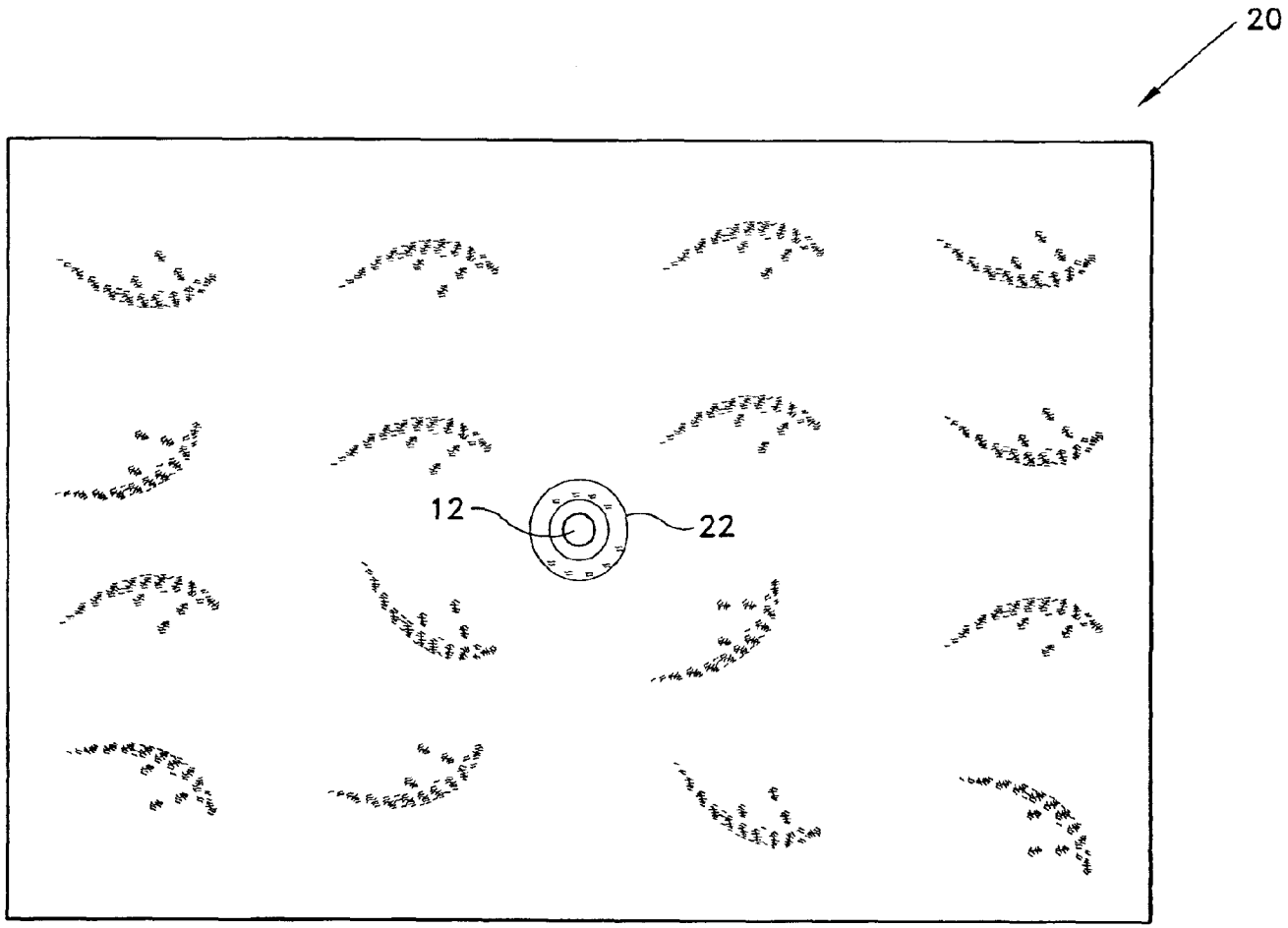

FIG. 1C has a circular pillow 20 surrounding the aperture 12 of towel 22.

Figure 1D:
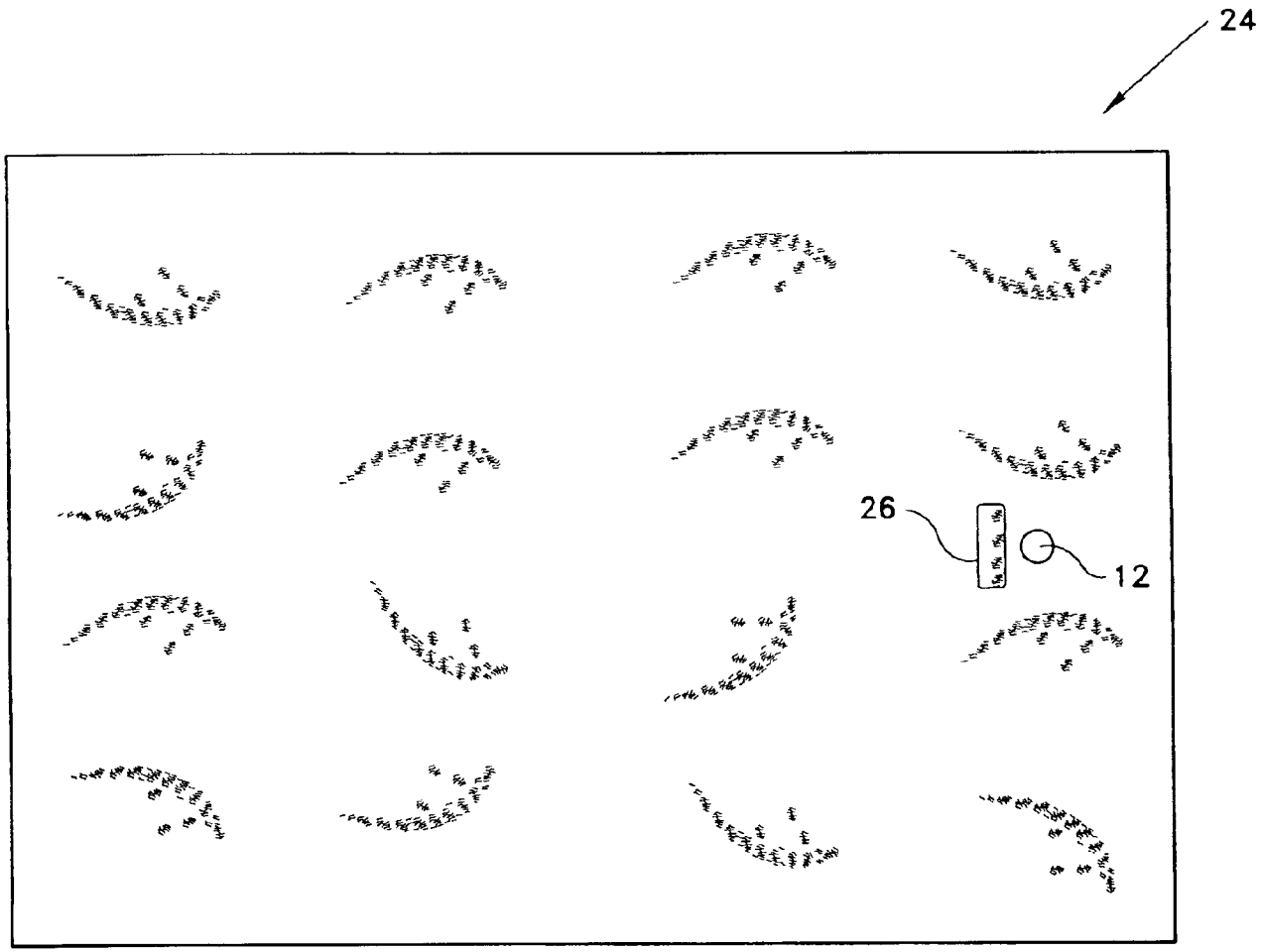

FIG. 1D has the aperture 12 located adjacent one short end of the towel 24 with a rectangular pillow 26 located on the 10 inside of the aperture.

Figure 1E:
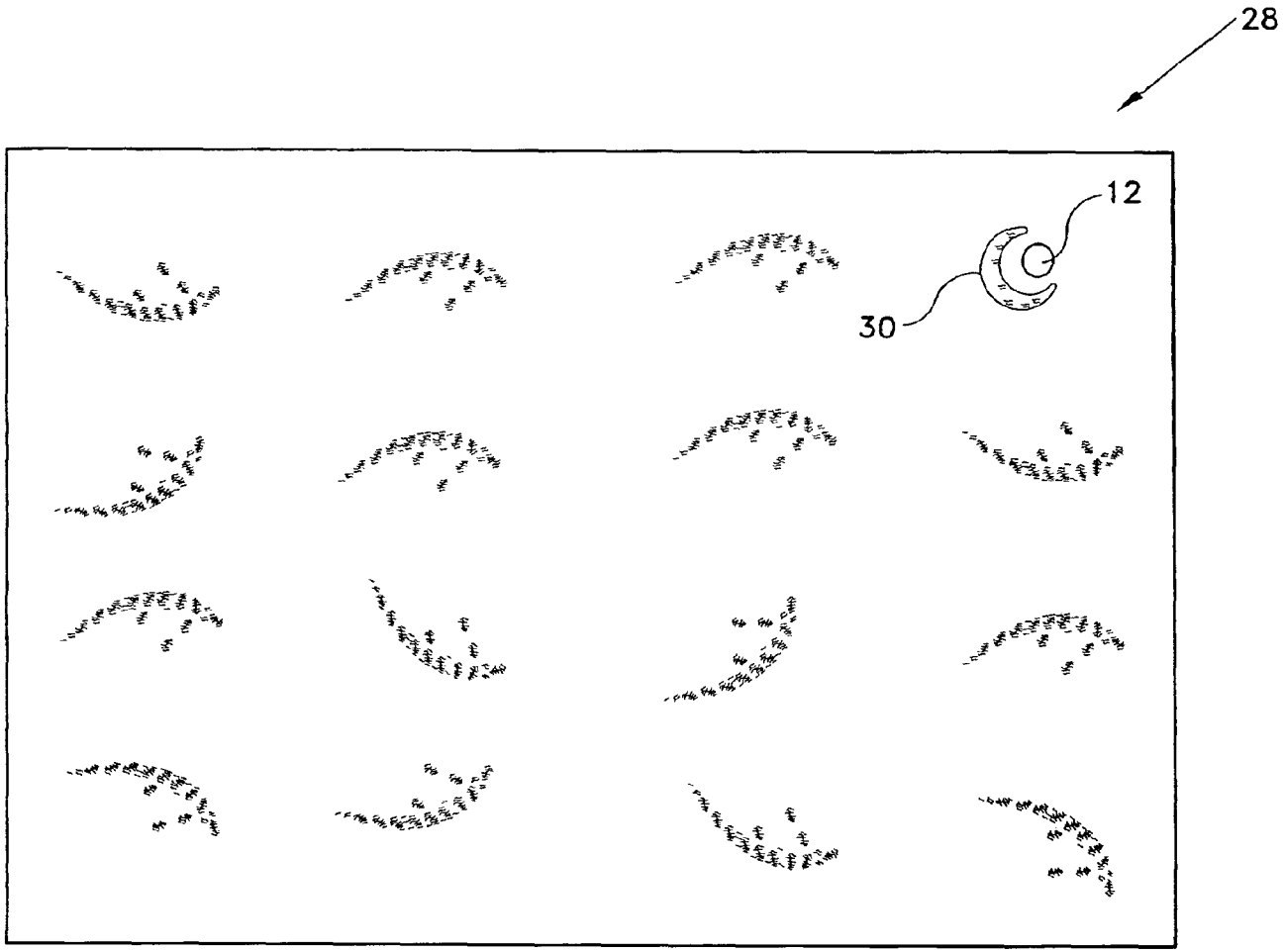

FIG. 1E has the aperture 12 in a corner with a crescent moon-shaped pillow 30 opposite the aperture and the corner.

Figure 1F:
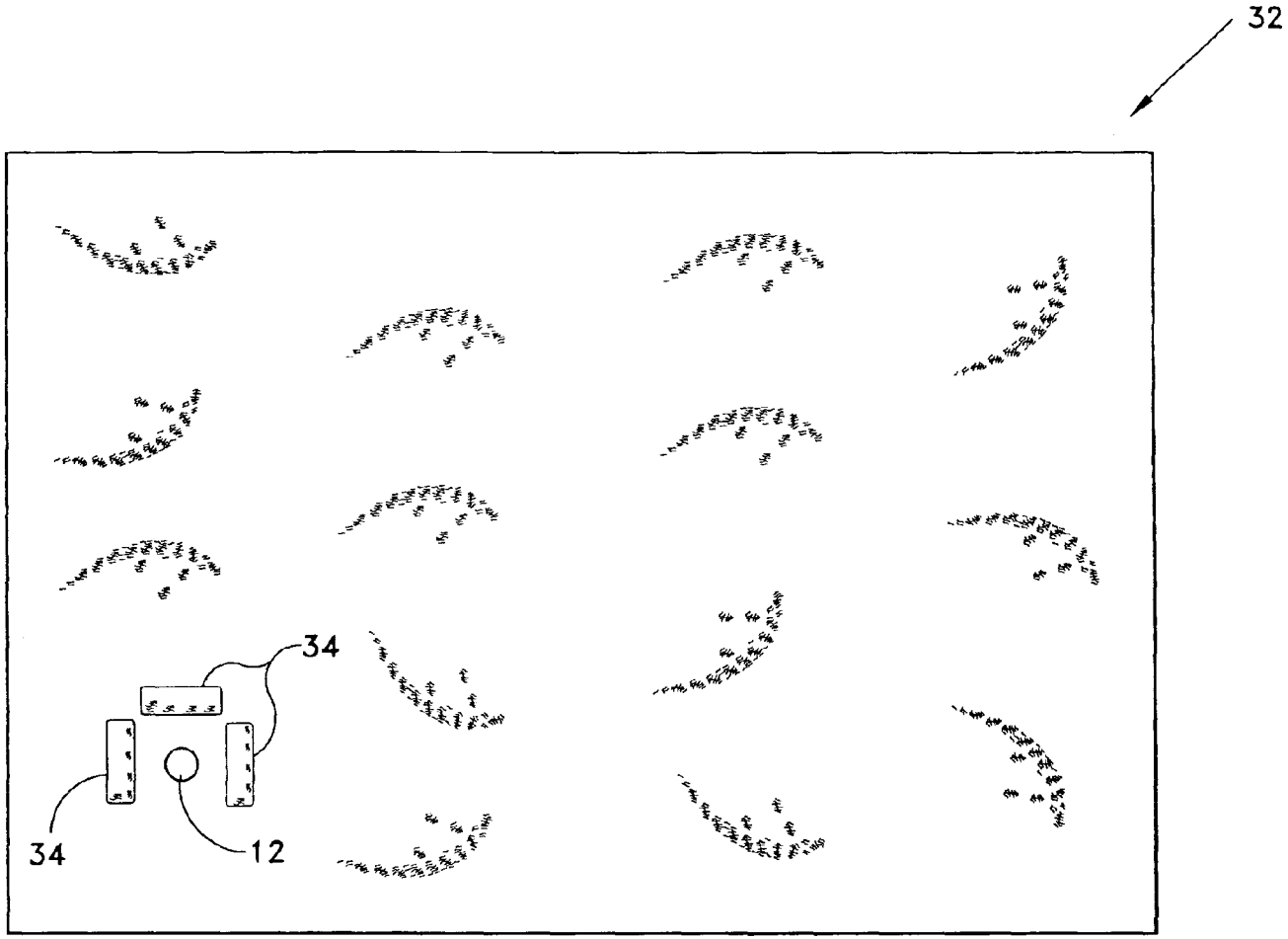

FIG. 1F has the aperture 12 in a corner with three attached rectangular pillows 34 surrounding the aperture except for an open side. The pillows 34 form an inverted "U" configuration around the aperture.

The dimensions of the rectangular towels 10, 16, 20, 24, 28, and 32 are preferably 9 feet by 6 feet, but can clearly be any size. The rectangular towels can have up to six pillows, but up to 4 pillows is preferred. The apertures 12 can be any size appropriate for the specific handle of an umbrella used, but a three-inch diameter is preferred. The pillows can be 5 in. to 10 in. in width, 2 in. 4 in. thick, and 4 ft. to 6 ft. in length; but 5.5 in. in width, 2.75 in. thickness, and a length of 8.5 in. is preferred.

Figure 2A:
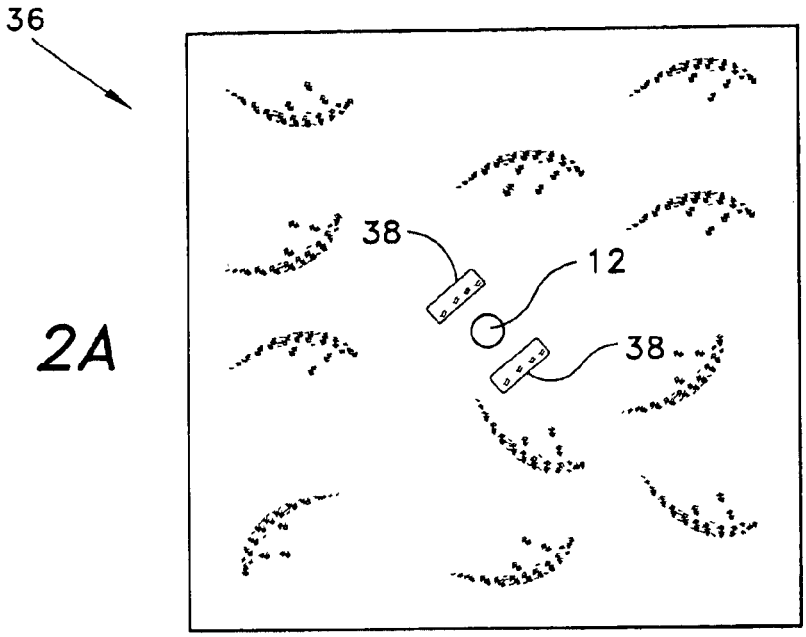
FIGS. 2A–2D are top plan views of four different arrangements of square beach towels, wherein each towel has an aperture for a beach umbrella and pillow(s).
Figure 2B:
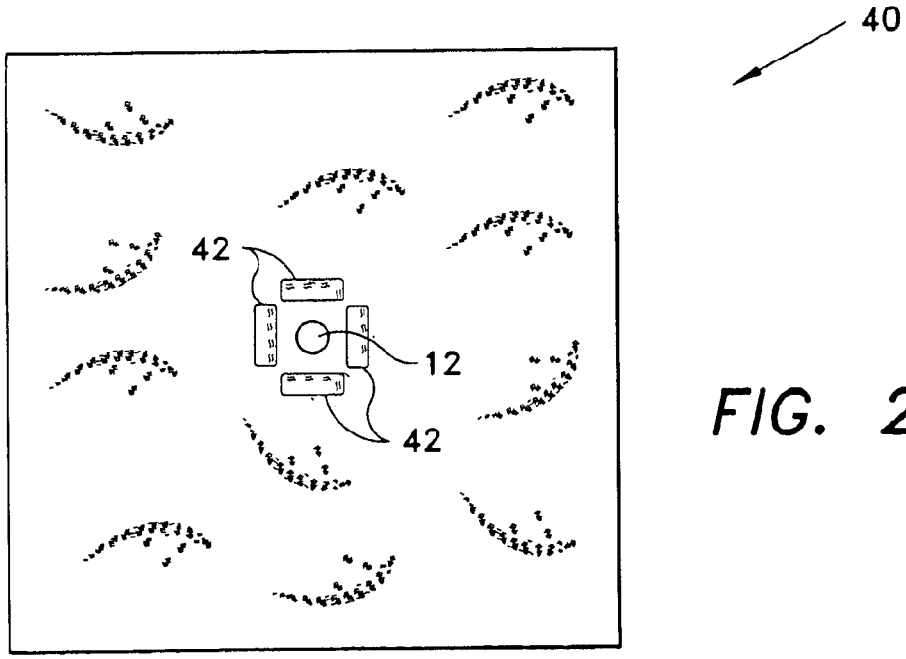
Figure 2C:
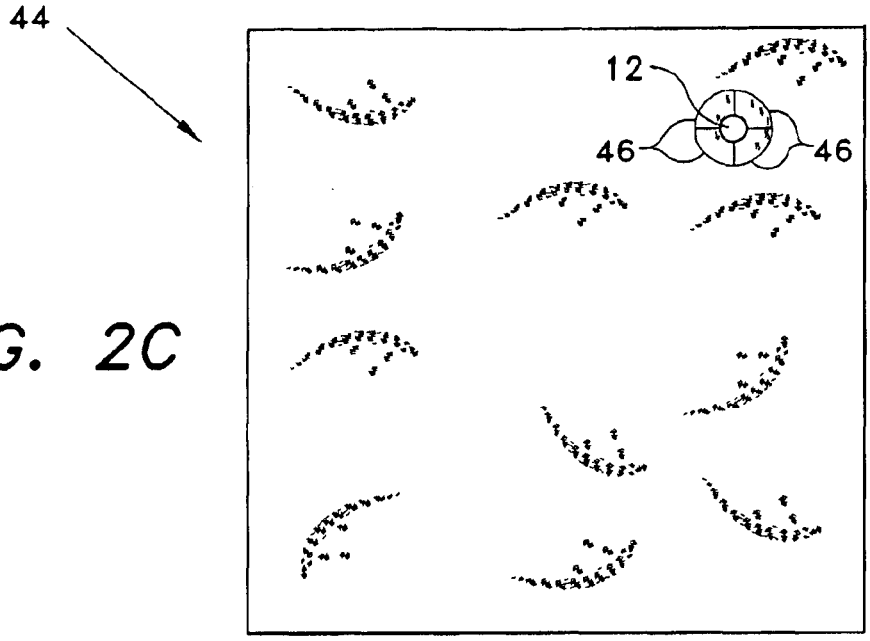
Figure 2D:
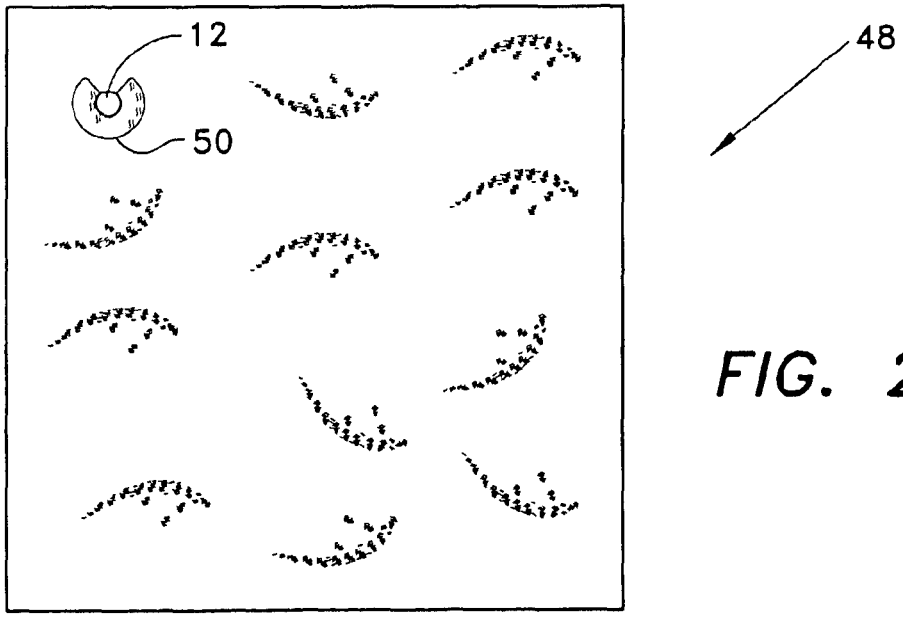

Turning to the second embodiment of square beach towels, FIG. 2A illustrates a square towel 36 having two rectangular pillows 38 straddling the aperture 12. FIG. 2B depicts a square beach towel 40 having four rectangular pillows 42 equidistantly spaced around the aperture 12 in the form of a square. FIG. 2C shows a square towel 44 having the aperture 12 in a corner surrounded by four equal sized 90-degree pillows 46 to form a circle. FIG. 2D illustrates a square towel 48 having the aperture 12 in a corner partially surrounded by circular pillow 50 covering an arc of 270 degrees.

The square towels 36, 40, 44, and 48 are preferably 8 ft. by 10 ft. The pillows can number up to six, but up to four pillows is preferred. The aperture 12 is preferably 3 inches in diameter. The pillow size can be 6 to 10 inches long, 2 to 4 inches in thickness, and 4 to 6 inches wide, but a preferred size is 8.5 inches in length, 5.5 inches wide, and 2.75 inches thick.

Figure 3A:
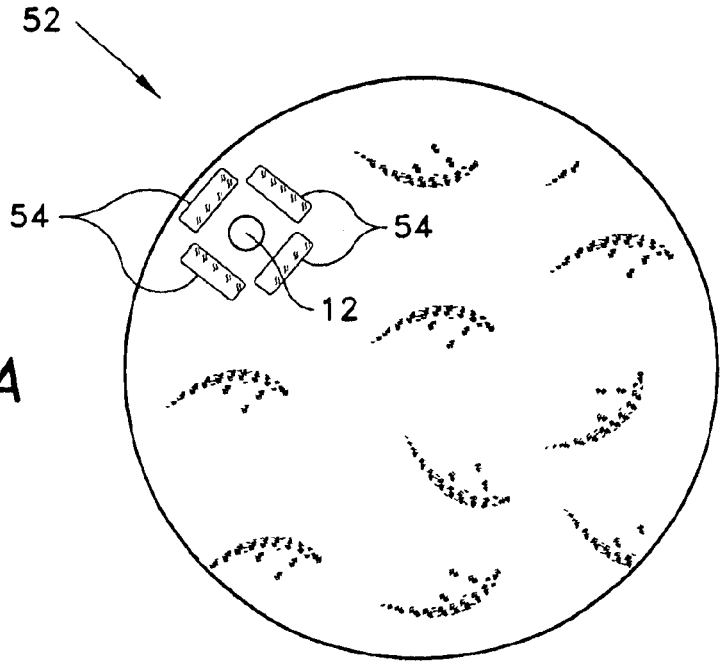
FIGS. 3A–3D are top plan views of four different arrangements of circular beach towels, wherein each towel has an aperture for a beach umbrella and pillow(s).
Figure 3B:
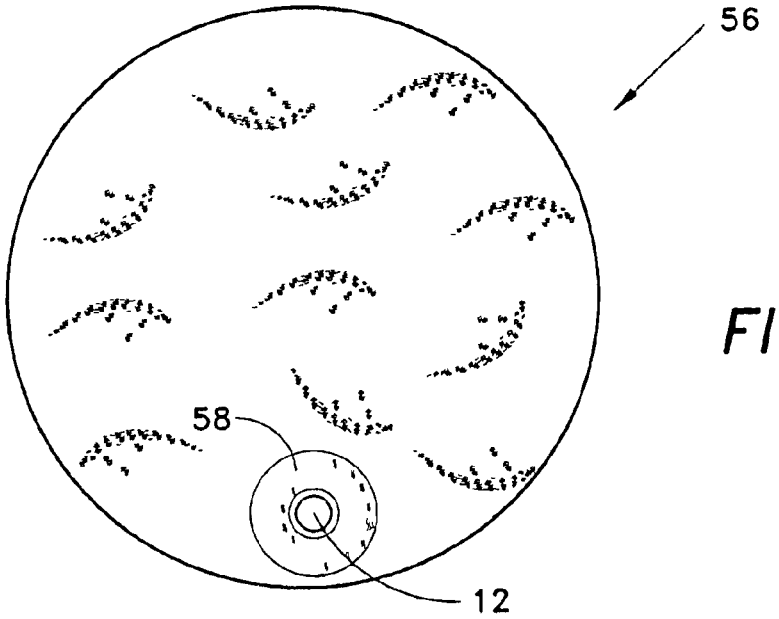
Figure 3C:
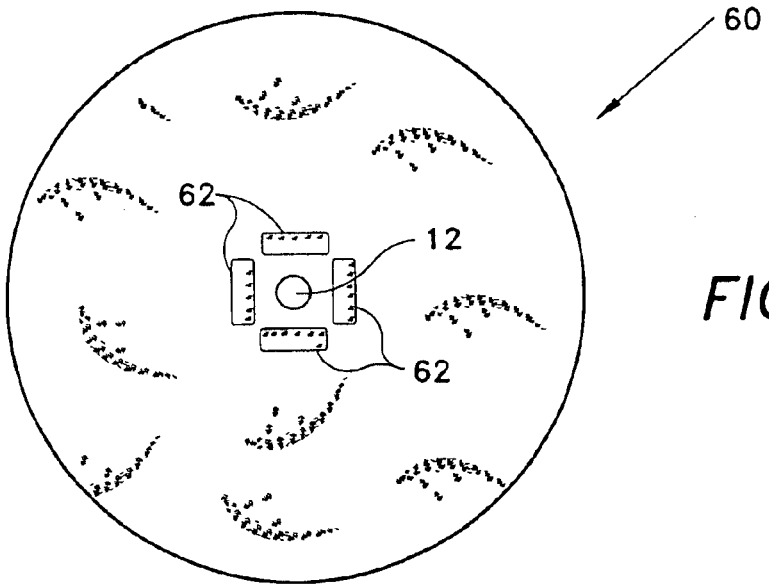
Figure 3D:
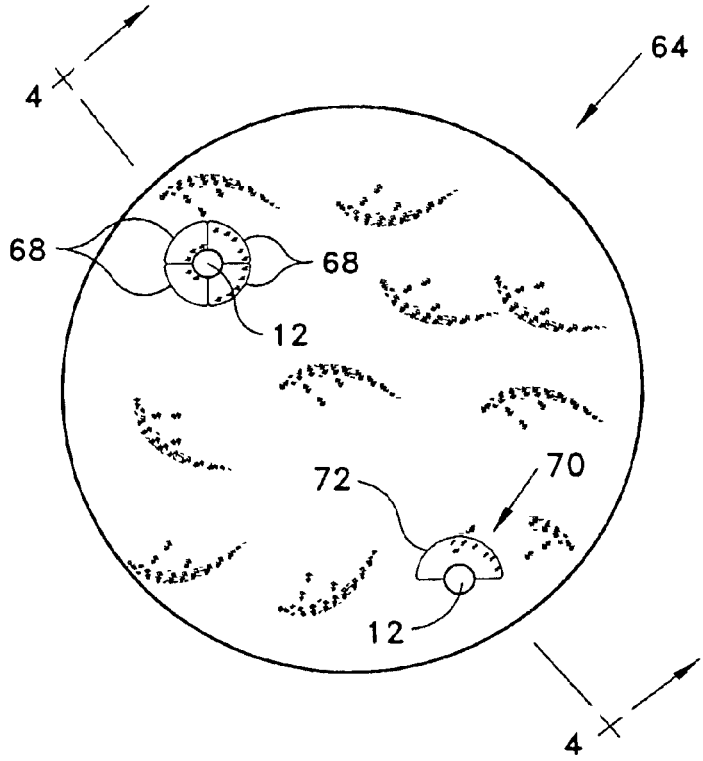

Turning now to third and last embodiment of the present invention illustrated in FIGS. 3A to 3D, a circular towel 52 in FIG. 3A has the aperture 12 surrounded by four rectangular pillows 54 adjacent the edge. FIG. 3B shows a circular towel 56 having its aperture 12 surrounded by a circular pillow 58. FIG. 3C has a centered aperture 12 surrounded by four rectangular pillows 62 to form a square configuration. FIG. 3D depicts a circular towel 64 having two apertures 12 located opposite each other adjacent the edge of the towel 64. The first configuration 66 surrounds aperture 12 four arcuate pillows 68. The second configuration 70 has a semicircular pillow 72 adjacent the aperture 12. Thus, two umbrellas can be placed in the circular towel 64 for housing or protecting two groups of children.

The preferred size of a circular towel has a diameter of 3 to 5 feet. The circular towel can have up to six pillows, but up to four pillows is preferred. The preferred size of the aperture for the umbrella is 3 inches in diameter. The pillows can be 6 to 10 inches in length, 2 to 4 inches in thickness, and 4 to 6 inches in width. A preferred size is 8.5 inches long, 5.5 inches wide, and 2.75 inches in thickness.

The preferred towel fabric is cotton, but other materials such as polyester can be utilized. The pillow fabric can be identical to the towel fabric. The pillow filling is preferably polyester. The ends of the pillows are wrapped up around the pillow and folded up for storage in a bag if detachable from the towel.

It should be noted that the pillows of any configuration can have ends which are not perpendicular.

Thus, various towel shapes, various locations of the aperture(s), and various shapes and number of pillows have been shown for the satisfaction of any user.

It is to be understood that the present invention is not limited to the embodiments described above, but encompasses any and all embodiments within the scope of the following claims.

We claim:

1. A beach umbrella towel, comprising:

a towel having a circular shape;

a plurality of stuffed arcuate pillows;

a first aperture located adjacent an edge of the towel and equidistantly surrounded by at least four of said plurality of stuffed arcuate pillows; and a second aperture located opposite the first aperture and adjacent an edge of the towel, and having at least two of said plurality of stuffed arcuate pillows forming a semicircular shape adjacent and equidistantly from the aperture;

whereby a beach umbrella post is inserted in one of the apertures.

2. The beach umbrella towel according to claim 1, whereby an additional beach umbrella post is inserted in the second aperture.

3. A beach umbrella towel, comprising:

a towel having a geometric shape selected from the group consisting of a rectangle, a square, and a circle;

an aperture located in said towel in a position selected from the group consisting of the center, and edge, and a corner;

at least one stuffed pillow having a shape selected from a rectangle, a circle, and arcuate;

said at least one stuffed pillow being movably coupled to said towel; and means for movably attaching said at least one stuffed pillow to said towel;

wherein said means for attaching is sewing;

whereby a beach umbrella post is inserted in said aperture, and said at least one stuffed pillow is arranged proximate said aperture.

4. A beach umbrella towel, comprising:

a towel having a geometric shape selected from the group consisting of a rectangle, a square, and a circle;

an aperture located in said towel in a position selected from the group consisting of the center, an edge, and a corner;

at least two stuffed rectangularly shaped pillows movably coupled to said towel; and means for movably attaching each said at least two stuffed rectangularly shaped pillows to said towel;

wherein said means for attaching is sewing;

whereby a beach umbrella post is inserted in said aperture, and each said at least two stuffed rectangularly shaped pillows are movably arranged proximate said aperture.

5. The beach umbrella towel according to claim 4, wherein the aperture is located in the center of the towel and the at least two stuffed pillows numbers four stuffed rectangular pillows attached proximate and equidistant to the aperture to form a square configuration.

6. The beach umbrella towel according to claim 4, wherein the at least two stuffed pillows numbers three stuffed rectangular pillows equidistantly surrounding the aperture in a corner of the towel.

7. The beach umbrella towel according to claim 4, wherein the towel is square in shape, the aperture is located in the center, and the at least two stuffed pillows numbers two stuffed rectangular pillows in parallel surrounding and equidistantly spaced about the aperture.

8. The beach umbrella towel according to claim 4, wherein the towel is square in shape, the aperture is located in the center, and the at least two stuffed pillows numbers four stuffed rectangular pillows adjacent and equidistant from the aperture.

9. The beach umbrella towel according to claim 4, wherein the towel is circular in shape, the aperture is located adjacent an edge, and the at least two stuffed pillows numbers three stuffed rectangular pillows adjacent and equidistantly spaced from the aperture.

10. The beach umbrella towel according to claim 4, wherein the towel is circular in shape, the aperture is located in the center, and the at least two stuffed pillows numbers four stuffed rectangular pillows equidistantly surrounding the aperture.

11. A beach umbrella towel, comprising:

a towel having a geometric shape selected from the group consisting of a rectangle, a square, and a circle;

an aperture located in said towel in a position selected from the group consisting of the center, and edge, and a corner;

a plurality of stuffed arcuately shaped pillows movably coupled to said towel; and means for movably attaching each one of said plurality stuffed arcuately shaped pillows to said towel;

wherein said means for attaching is sewing;

whereby a beach umbrella post is inserted in said aperture, and each one of said plurality stuffed arcuately shaped pillows are movably arranged proximate said aperture.

12. The beach umbrella towel according to claim 11, wherein the aperture is located in the center of the towel and said plurality of stuffed pillows numbers four stuffed arcuate pillows attached equidistantly surrounding the aperture.

13. The beach umbrella towel according to claim 11, wherein the towel is square in shape, the aperture is located in a corner, and said plurality of stuffed pillows numbers four stuffed arcuate and adjacent pillows equidistantly surrounding the aperture.

* * * * *